US007211305B2

(12) United States Patent
Steiger et al.

(10) Patent No.: US 7,211,305 B2
(45) Date of Patent: May 1, 2007

(54) HOLIDAY COUNTDOWN INTERACTIVE DISPLAY

(75) Inventors: Therese F. Steiger, Liberty, MO (US); Nancy Short, Roeland Park, KS (US); Ruth Donikowski, Kansas City, MO (US); Kristine Larsen, Prairie Village, KS (US); Keri Lauderdale Olson, Lee's Summit, MO (US); Tim Staley, Lenexa, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 217 days.

(21) Appl. No.: 10/710,924

(22) Filed: Aug. 12, 2004

(65) Prior Publication Data

US 2006/0062940 A1 Mar. 23, 2006

(51) Int. Cl.

| | |
|---|---|
| ***A47G 33/00*** | (2006.01) |
| ***G09D 3/00*** | (2006.01) |
| ***G09D 3/02*** | (2006.01) |
| ***G09D 3/04*** | (2006.01) |
| ***G09D 3/12*** | (2006.01) |
| ***G09F 19/00*** | (2006.01) |

(52) U.S. Cl. ..... 428/7; 428/542.6; 40/107; 283/100; 434/304; 434/429

(58) Field of Classification Search ..... 428/7, 428/542.6; 40/107; 283/100; 434/304, 434/429; D19/24

See application file for complete search history.

(56) References Cited

U.S. PATENT DOCUMENTS

| | | | |
|---|---|---|---|
| 1,853,164 | A | 4/1932 | Block |
| D95,468 | S | 4/1935 | Van Marter |
| D97,891 | S | 12/1935 | Baur |
| D99,833 | S | 5/1936 | Siemund |
| 2,149,968 | A | 3/1939 | Kranz et al. |
| 2,171,116 | A | 8/1939 | Muldoon |
| 2,203,016 | A | 6/1940 | Hahn et al. |
| D124,036 | S | 12/1940 | Kranz et al. |
| D142,323 | S | 8/1945 | Judd |
| 2,440,062 | A | 4/1948 | Allen |

(Continued)

FOREIGN PATENT DOCUMENTS

| | | |
|---|---|---|
| DE | 3737971 | 5/1989 |

OTHER PUBLICATIONS

Casual Living Holiday II Catalog, 2001, pp. 3 and 35.

*Primary Examiner*—John J. Zimmerman
*Assistant Examiner*—Aaron Austin
(74) *Attorney, Agent, or Firm*—Fish & Richardson P.C.

(57) ABSTRACT

A holiday countdown interactive display may include a set of magnetically attachable ornaments that have discrete appearances and functionalities, each ornament being marked with a distinct number associated with the number of days remaining before a holiday. In certain preferred embodiments, the interactive display comprises a plush fabric base generally in the shape of a Christmas tree and containing a plurality of rare earth magnets disposed beneath countdown numbers borne on the exterior of the plush fabric base. The interactive display system may further include a plurality of numbered plush Christmas ornaments each including rare earth magnets, the ornaments adapted to be successively installed on the plush fabric base on the days preceding a holiday event. In various embodiments, the ornaments include power supplies, controllers, vibratory elements, LEDs, speakers, pockets for containing gift items, messages, or the like.

7 Claims, 8 Drawing Sheets

U.S. PATENT DOCUMENTS

| | | | | |
|---|---|---|---|---|
| D165,732 | S | | 1/1952 | Anderson |
| 2,587,788 | A | | 3/1952 | Tacy |
| 2,732,646 | A | | 1/1956 | James |
| D184,055 | S | | 12/1958 | Johnson |
| 2,914,871 | A | | 12/1959 | Smith et al. |
| 3,219,512 | A | | 11/1965 | Kovacevic |
| D203,446 | S | | 1/1966 | Napier |
| 3,544,783 | A | | 12/1970 | Williams, Sr. |
| D224,610 | S | | 8/1972 | Dustman |
| D232,947 | S | | 9/1974 | Christiansen |
| 4,435,452 | A | | 3/1984 | Hernandez et al. |
| 4,937,107 | A | | 6/1990 | Mirisch, Sr. |
| 4,939,004 | A | | 7/1990 | Fuss |
| 4,975,061 | A | | 12/1990 | Avrill |
| 5,058,296 | A | | 10/1991 | Notzel |
| 5,071,098 | A | | 12/1991 | Aldridge |
| D327,232 | S | | 6/1992 | Winn |
| D349,359 | S | | 8/1994 | McLaughlin, II |
| D354,252 | S | | 1/1995 | Smith et al. |
| D386,111 | S | | 11/1997 | Kinsey |
| D387,699 | S | | 12/1997 | Chen |
| 5,799,423 | A | * | 9/1998 | Malino ..... 40/107 |
| D406,787 | S | | 3/1999 | Kan |
| D413,831 | S | | 9/1999 | Grounds |
| 5,983,542 | A | | 11/1999 | Chen |
| 5,996,116 | A | * | 12/1999 | Tate ..... 2/12 |
| D435,479 | S | | 12/2000 | Gansbuehler |
| 6,280,200 | B1 | | 8/2001 | Cunningham |
| D456,303 | S | | 4/2002 | Bunch |
| D458,407 | S | | 6/2002 | Yu |
| D472,844 | S | | 4/2003 | Chi |
| 6,581,310 | B1 | | 6/2003 | Ferrier |
| D486,754 | S | | 2/2004 | Shiratori |
| 7,017,292 | B1 | * | 3/2006 | Abelarde ..... 40/110 |
| 2004/0079005 | A1 | * | 4/2004 | Davis et al. ..... 40/107 |

* cited by examiner

HOLIDAY COUNTDOWN INTERACTIVE DISPLAY

BACKGROUND OF INVENTION

This invention relates to holiday decorations and, in particular embodiments, to decorative plush articles for interactively counting down the days preceding a holiday.

Households are often adorned with decorations and ornamentation contemporaneously with the celebration of various holidays and other special events. Various types of decorations and ornamentation have been used to decorate homes, workplaces and retail environments in the months leading up to major holidays such as Christmas, Ramadan, and Hanukah. These decorations include trees, wreaths, ornaments, and other festive holiday trimmings. The decorations create a festive spirit and serve as reminders that a special event is nearing.

While certain decorations are simply aesthetic and provide basic visual satisfaction for the people that see them, other decorations include various types of interactive functionality. These interactive decorations allow their users to take a more active role in the holiday.

Another form of holiday decoration is a countdown display. Generally speaking, countdown displays are flat cardstock products which have a plurality of die-cut flap sections having distinct numbers printed on them, each number being associated with the days remaining before a major holiday. On each day leading up to the holiday, a user (often a child) lifts the die-cut flap associated with the number of days remaining before the holiday. Under each flap is a distinct image or message. The countdown display thereby helps build excitement in the days leading up the actual holiday.

SUMMARY OF INVENTION

A holiday countdown interactive display may include a set of magnetically attachable ornaments that have discrete appearances and functionalities, each ornament being marked with a distinct number associated with the number of days remaining before a holiday. In certain preferred embodiments, the interactive display comprises a plush fabric base generally in the shape of a Christmas tree and containing a plurality of rare earth magnets disposed beneath countdown numbers borne on the exterior of the plush fabric base. The interactive display system may further include a plurality of numbered plush Christmas ornaments each including rare earth magnets, the ornaments adapted to be successively installed on the plush fabric base on the days preceding a holiday event. In various embodiments, the ornaments include power supplies, controllers, vibratory elements, LEDs, speakers, pockets for containing gift items, messages, or the like. In certain embodiments, the fabric base unit may include a power supply, a controller, and one or more electronic element that is activated in response to user stimulus. In some embodiments, the fabric base unit may include a compartment to store unused ornaments or other holiday items.

The details of one or more embodiments are set forth in the accompanying drawings and the description below. Other features, objects, and advantages will be apparent from the description and drawings, and from the claims.

BRIEF DESCRIPTION OF DRAWINGS

Like reference symbols in the various figures indicate like elements.

DETAILED DESCRIPTION

Figure 1:
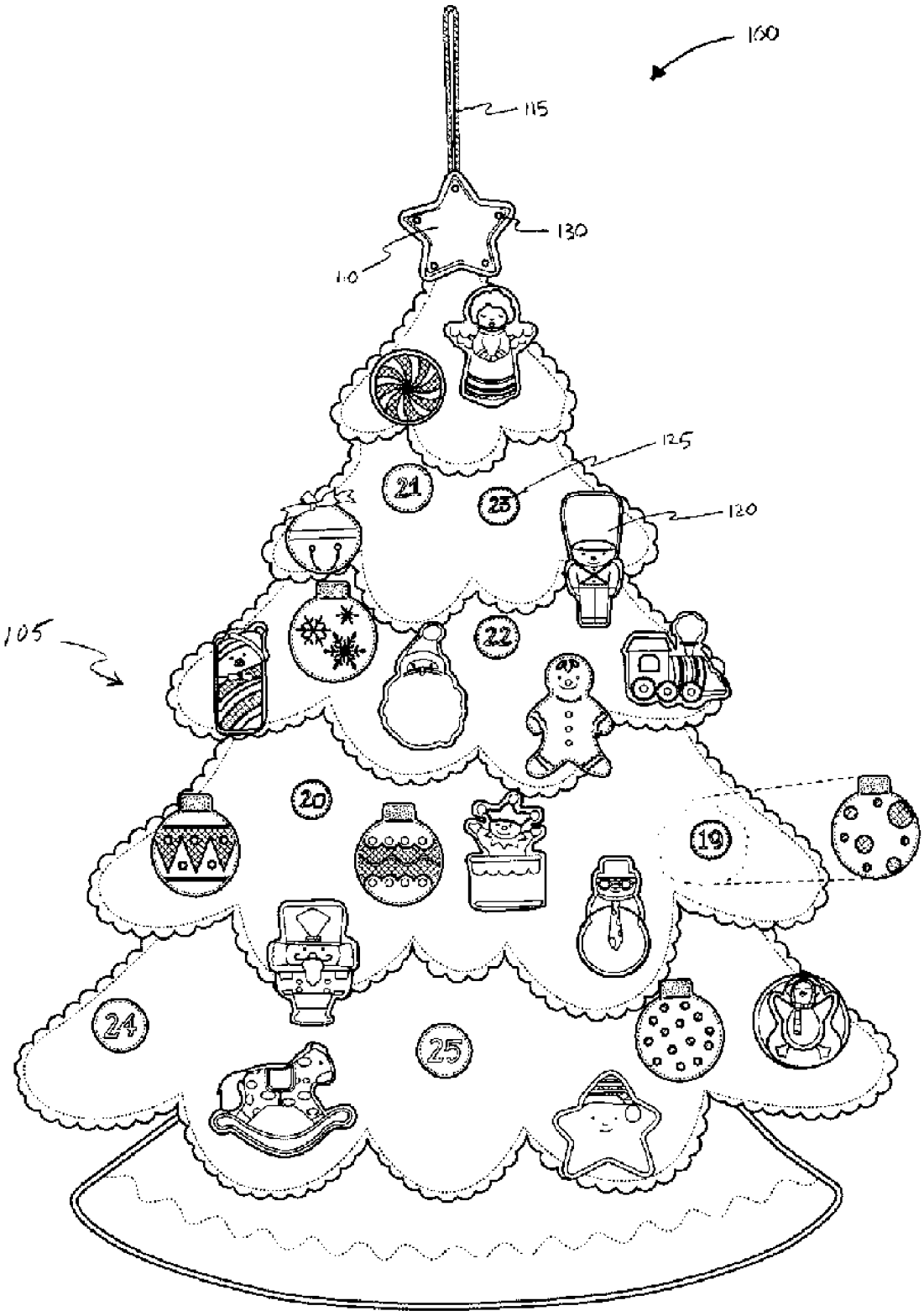
FIG. 1 is a perspective view of a fabric interactive display in accordance with one embodiment of the invention.
Figure 2:
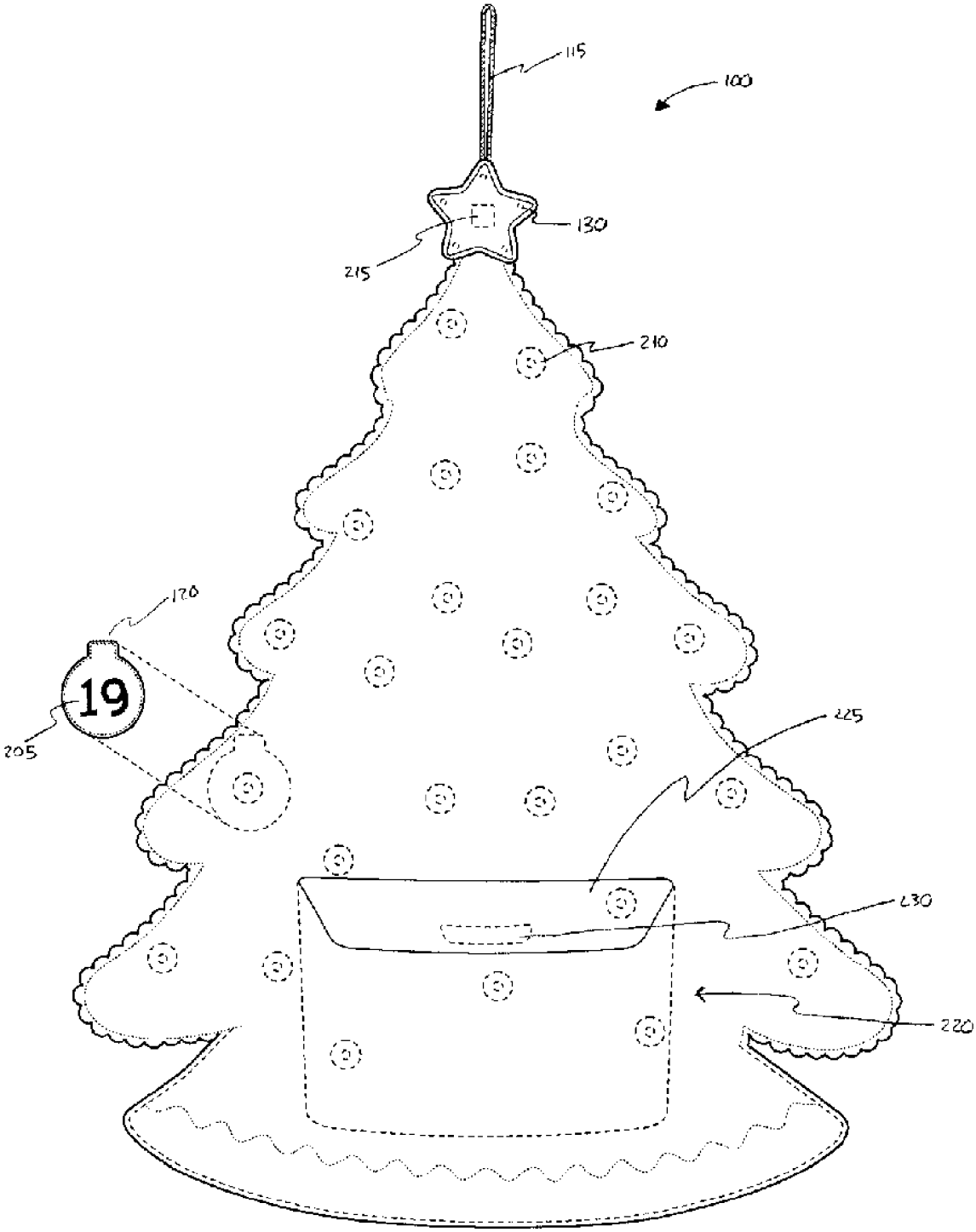
FIG. 2 is a rear view of the article shown in FIG. 1.
Figure 3A:
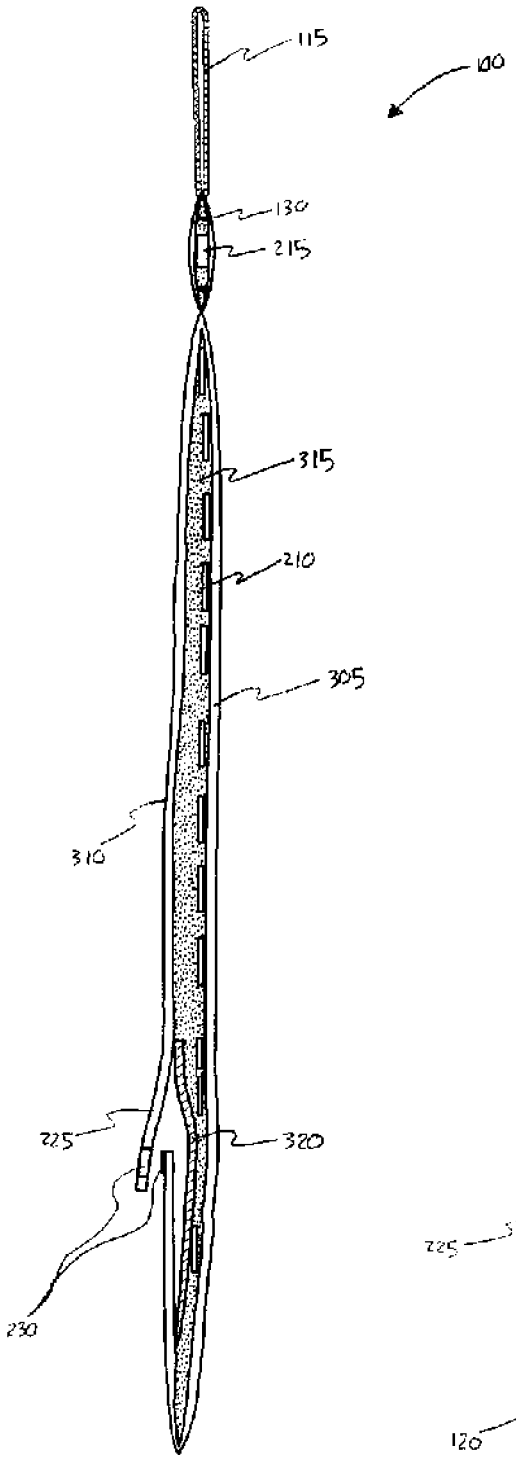
FIG. 3A is a cross-sectional view of the fabric article shown in FIG. 1.

FIGS. 1–3 show a fabric article 100. The fabric article 100 may include a countdown section 105, an interactive section 110, and a hanging device 115. In some embodiments, the countdown section 105 and the interactive section 110 may be combined, and in other embodiments they may be separate. FIG. 1 shows eighteen decorative ornaments 120 attached to the countdown section 105 of the fabric article 100. FIG. 1 also shows one decorative ornament 120 that is detached from the fabric article 100. As depicted in FIG. 3A, the fabric article 100 may be constructed of a front panel 305 and a rear panel 310. These panels are discussed in further detail in association with FIG. 3A.

The countdown section 105 of the fabric article 100 may include a plurality of countdown labels 125 spaced laterally apart from one another. The countdown labels 125 may be consecutively numbered to indicate the number of days remaining until a holiday. For example, a countdown to Christmas may include countdown labels 125 numbered consecutively from twenty-five to one to represent each of the twenty-five days in December leading up to and including Christmas day. The countdown labels 125 may also reflect the number of days remaining until a holiday using other indicia, such as days of the week or pictures instead of numbers. For example, the countdown labels 125 may include pictures associated with the Twelve Days of Christmas, such that with two days left before Christmas, the countdown label 125 would resemble two turtledoves.

Figure 9:
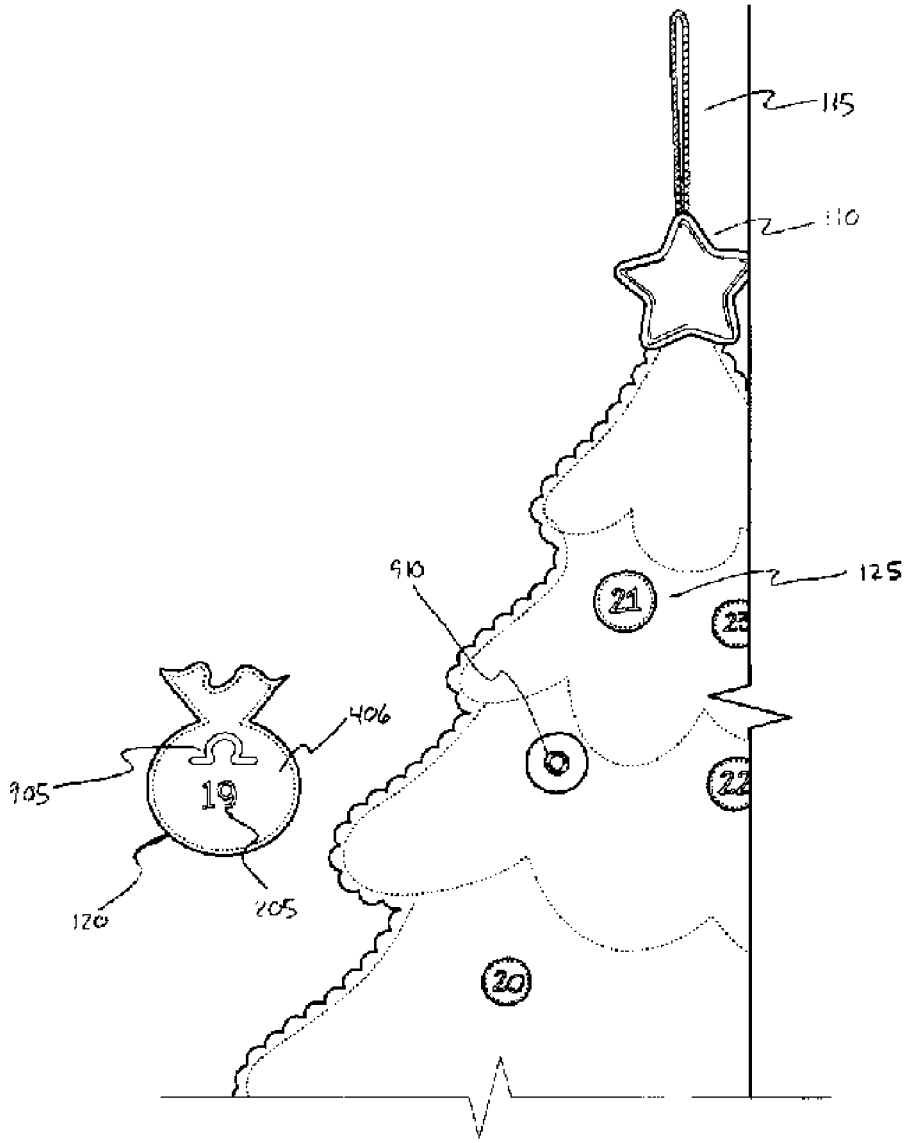
FIG. 9 is a partial front view of an additional embodiment of the invention.

The countdown labels 125 may be attachments that are separate from the fabric article 100, thus allowing for compatibility with other fabric articles 100. An example of this type of detachable countdown label 125 could be removable buttons attached to stems, where the stems are permanently affixed to the fabric article 100 but the buttons could attach to any of the different stems on any given fabric article 100. These detachable buttons would allow for several different variations and decoration schemes rather than a predictable and fixed numbering scheme for the countdown labels 125. In a different embodiment, the countdown labels 125 may be permanently affixed to the fabric article 100 or even printed directly on the fabric article 100. The countdown labels 125 may also be used as mechanical attachment devices that allow affixation of the decorative ornaments 120 via mechanical means, such as where the countdown label buttons receive a loop of string attached to an ornament. Alternately, a decorative ornament 120 having a hook 905 may allow for mechanical attachment to certain embodiments of countdown labels 125 as shown in FIG. 9 and described in more detail below.

Returning to FIG. 1, the interactive section 110 of the fabric article 100 includes one or more electrically active devices 130 that may be activated in response to different types of stimuli. These electrically active devices 130 may include speakers, lights, and or vibratory devices, for example. For instance, the interactive section 110 may include a controller, a series of lights and a speaker, the controller being programmed to illuminate the lights in synchronicity with music.

In some embodiments, the controller disposed in the interactive section 110 may respond to a signal from a pressure sensitive switch so that the reactive section 110 responds to the touch or grasp of a user. In other embodiments, the reactive section 110 may respond to a magnetic stimulus such as the attachment of a magnetic decorative ornament 120 to the fabric article 100. In such embodiments, a Reed switch may be used in lieu of a pressure sensitive switch to sense the proximity of magnetic materials. The electrically active devices 130 in the interactive section 110 are controlled by a controller 215, which is further described along with FIG. 8.

The hanging device 115 allows the fabric article 100 to be attached to a surface for display. The hanging device 115 may be a loop attached to the fabric article 100 for hanging the fabric article 100 from a surface. The hanging device 115 may also comprise a hook-and-loop fastener system or adhesive tape for attaching the fabric article 100 to a surface. Rather than using a mechanical coupling, the hanging device 115 may have a non-mechanical attachment means such as cooperating magnets. For example, the fabric article 100 may be hung on a refrigerator door using primary magnets 210 that are already contained within the fabric article 100. These primary magnets 210 are discussed in greater detail in association with FIG. 2. In other embodiments, the hanging device 115 may be made up of a combination of mechanical devices and/or non-mechanical devices. If outwardly exposed, the hanging device 115 may be festively decorated with designs associated with a holiday.

FIG. 2 shows a rear view of the fabric article 100 and a rear view of a decorative ornament 120. The back side of a decorative ornament 120 may include an outwardly exposed ornament label 205 to display the number of days leading up to a given holiday. As with the countdown labels 125 discussed previously, the ornament labels 205 may either numerically or symbolically represent the number of days remaining until a holiday. These outwardly exposed ornament labels 205 also allow the user of the device to match up the decorative ornaments 120 with the corresponding countdown labels 125 disposed on the front of the fabric article 100. For example, the user may attach a decorative ornament 120 with an ornament label 205 numbered with a nineteen to the fabric article 100 where the countdown label 125 is also numbered with a nineteen, thus indicating that there are nineteen days remaining before the holiday. In some embodiments, the decorative ornaments 120 may not have ornament labels 205, or the ornament labels 205 may be detachable or otherwise interchangeable. In either of these embodiments, the decorative ornaments 120 may be placed on the fabric article 100 in association with any of the countdown labels 125. Also, although the previously mentioned embodiments discuss a rearward facing ornament label 205, the ornament labels 205 may be outwardly exposed on the front side of the decorative ornaments 120 as well.

As shown from the rear in FIG. 2, the aforementioned countdown section 105 of the fabric article 100 includes a plurality of primary magnets 210. The primary magnets 210 may optionally comprise a rare earth magnet, which demonstrates significant magnetic field strength with a relatively small footprint. The primary magnets 210 are disposed within the fabric article 100 and each primary magnet 210 is located proximately rearward of one of the countdown labels 125 displayed on the front of the fabric article 100. The secondary magnets 410 are discussed in greater detail in association with the different types of decorative ornaments 120 shown in FIGS. 4, 6, and 7.

Also shown in FIG. 2 is the controller 215 that controls the electrically active elements 130, which may be included as part of the interactive section 110 of the fabric article 100. As will be discussed in more detail in association with FIG. 8, the controller 215 may control the electrically active elements 130 by selectively applying voltage and/or generating appropriate timing, sequencing, or other control signals.

A storage compartment 220, which may be either coupled to or integrated with the fabric article 100, may be used to store detached decorative ornaments 120 or other items. The storage compartment may include a partially flexible flap 225 and may allow closure via either mechanical or non-mechanical means. For example, the closure mechanism may include a pair of hook-and-loop fastener strips 230. In other embodiments, the closure mechanism could be implemented with oppositely polarized magnets instead of the hook-and-loop fastener strips 230. The use of a storage compartment 220 with the fabric article 100 will be discussed further in association with FIGS. 3A & 3B.

FIG. 3A shows both the front panel 305 and the rear panel 310 of the fabric article 100 in a cross-sectional view. In some embodiments, fill material 315 may be enclosed between the front panel 305 and the rear panel 310. As shown in FIG. 3A, the aforementioned primary magnets 210 may be disposed between the front panel 305 and the rear panel 310 of the fabric article 100, with the primary magnets 210 being situated generally rearward of each countdown label 125. In other embodiments, the primary magnets 215 may be disposed within a dual-layer front panel 305. As an example of this particular embodiment, the primary magnets 215 may be sewn into the front panel 305. The primary magnets 210 may also be disposed in other areas throughout the fabric article 100.

Also shown in FIG. 3A is a storage compartment 220 that may be integrated with the rear panel 310 of the fabric article 100. In such an integrated embodiment, the storage compartment 220 may be defined externally by a separation in the rear panel 310 to allow access to the internal storage compartment 220. The storage compartment 220 may be defined internally by the inclusion of an internal lining 320 attached above and below the separation to the interior of the rear panel 310. In other embodiments, the storage compartment 220 may be in the form of an external compartment coupled to the exterior of the fabric article 100. For example, the storage compartment 220 may be sewn onto the exterior of the rear panel 310 or attached via other means. While each of the previously mentioned embodiments depicts or contemplates rearward facing storage compartments 220, the storage compartment 220 may also be integrated with or attached to the forward facing side of the fabric article 100. Such embodiments may include, but are not limited to, either a hidden storage compartment 220 on the front of the fabric article 100 or an externally visible storage compartment 220.

Figure 3B:
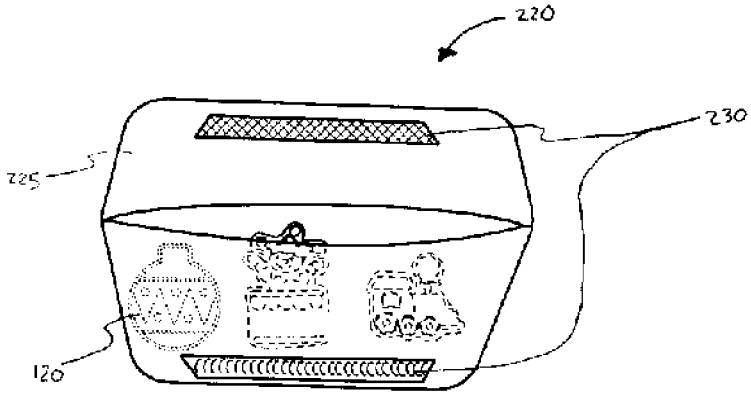
FIG. 3B is a front view of an optional, separately attachable storage unit.

The storage compartment 220 shown in FIG. 3B is representative of a non-integrated, external storage compartment 220 that may be coupled to the fabric article 100 as previously discussed. As shown in FIG. 3B, detached decorative ornaments 120 may be stored in the storage compartment 220 for safekeeping while they are not in use. Also depicted is one of the previously mentioned embodiments, namely one where the storage compartment 220 includes a partially flexible flap 225 which may be secured in a "closed" position by way of two hook-and-loop fastener strips 230.

Figure 4A:
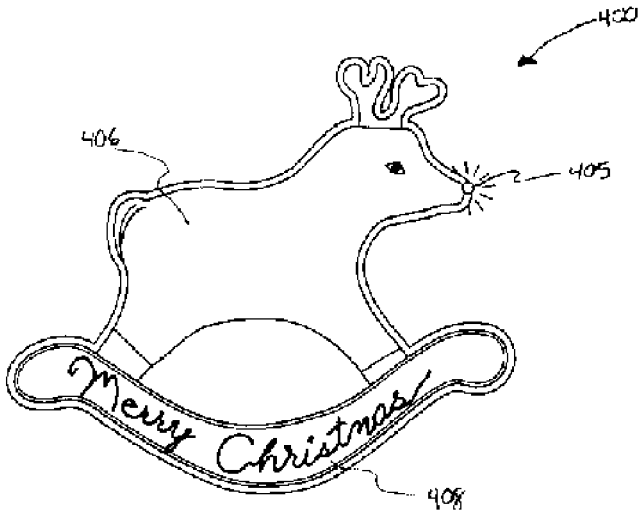
FIGS. 4A–4C illustrate various aspects of an exemplary countdown ornament.
Figure 4B:
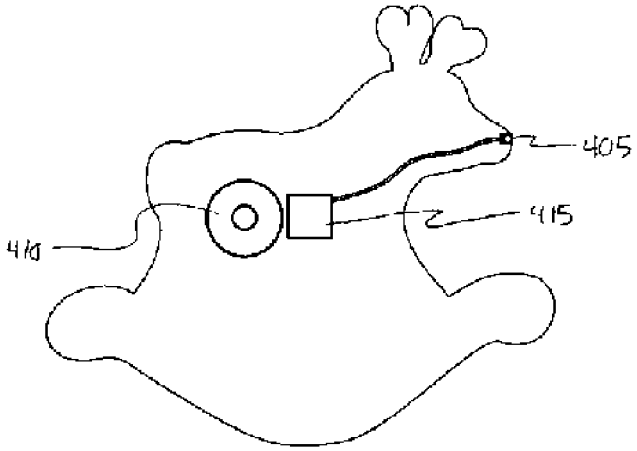

FIG. 4 shows an exemplary illuminable decorative ornament 400. Illuminable decorative ornament 400 have one or more illuminable parts 405 and a main body 406. The illuminable decorative ornament 400 may also include a secondary magnet 410 for attaching the ornament to the fabric article 100 by magnetic attraction to the primary magnets 210 disposed therein. The pattern and duration of the illumination may be controlled by a ornament controller 415, which may be included as part of the illuminable decorative ornament 400. In some embodiments, this ornament controller 415 may also be configured to control other elements such as speakers and vibratory elements.

Figure 4C:
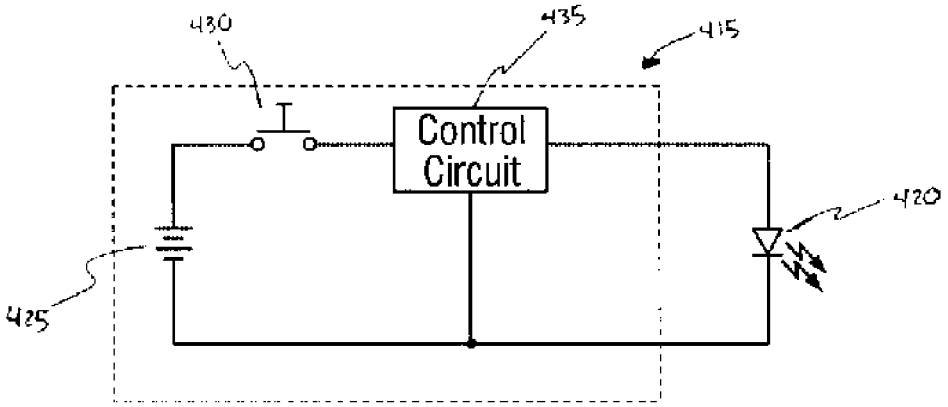

FIG. 4C shows an illustrative embodiment of a ornament controller 415. The ornament controller 415 may control the illumination of one or more LEDs 420 or other illuminable devices. The ornament controller 415 may comprise a power source 425, a switch 430, and an ornament control circuit 435. The power source 425 may, for example, be a battery. The switch 430 may be designed to respond to different types of stimuli. For example, the switch 430 may be a pressure-activated push button switch that activates the ornament control circuit 435 when pressed and deactivates the ornament control circuit 435 when released. In another embodiment, the switch 430 may be a toggle that provides power to the ornament control circuit 435 from the power supply 425 when toggled on and continues providing power to the ornament control circuit 435 until the switch 430 is toggled off.

The ornament control circuit 435, which is shown as part of the ornament controller 415 in FIG. 4C and is shown later as part of the sound controller 615 discussed in further detail in association with FIG. 6C, may be implemented in several different ways. In one embodiment, the ornament control circuit 435 may control the decorative ornament's 120 lights, sounds, or vibrations using a timer. For example, an LED 420 in a illuminable decorative ornament 400 may illuminate for a predetermined period of time before turning off. In another embodiment, the ornament control circuit 435 may output signals based upon a pattern generator or based on a pattern saved in memory associated with the control circuit 435. As an example, the speaker 620 in audio decorative ornament 600 may play the tune "Jingle Bells." A more specific example of a control circuit 435 is shown in FIG. 5 and is discussed in greater detail in association with that figure.

Figure 5:
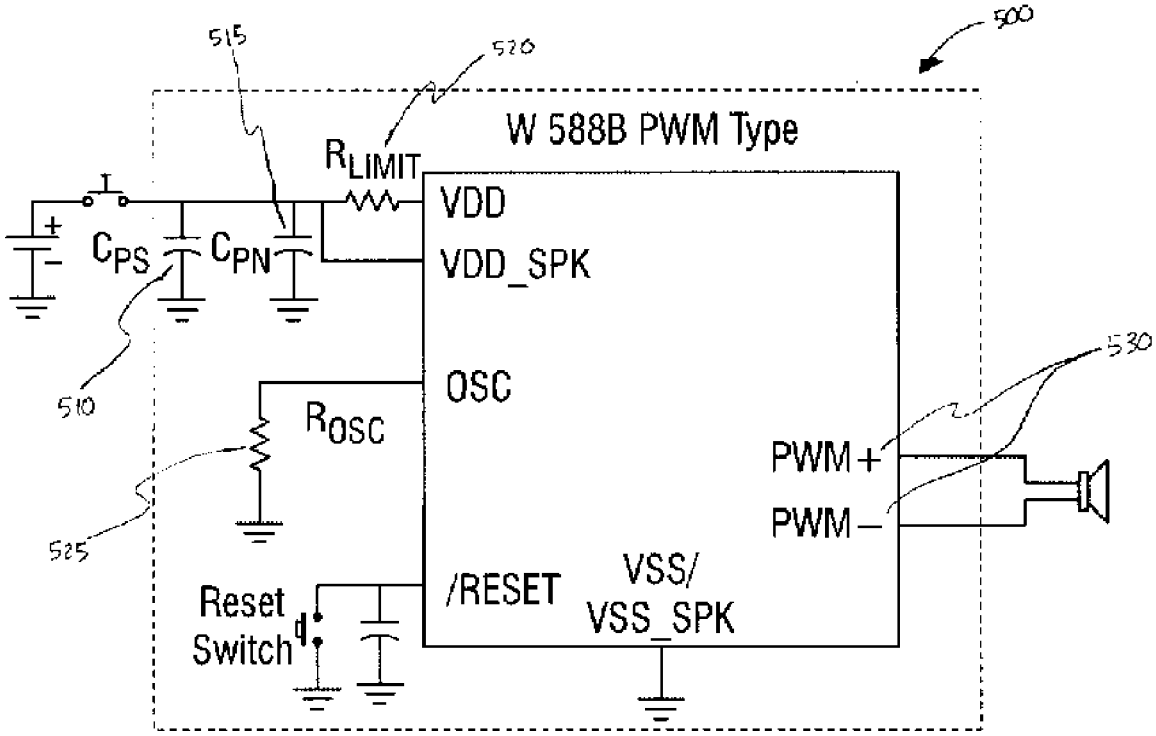
FIG. 5 is a schematic of an exemplary control circuit for use in connection with the embodiments of FIGS. 4C, 6C, and 8.
Figure 6A:
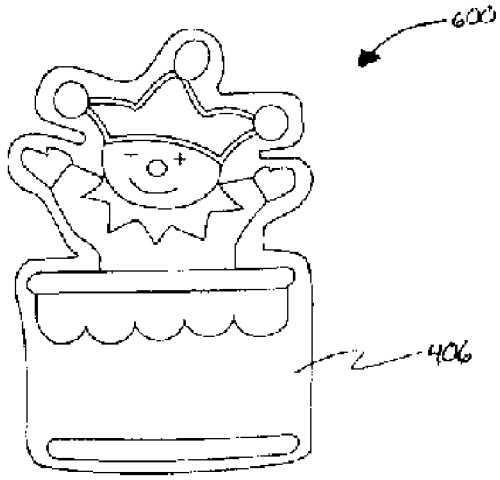
FIGS. 6A–6C illustrate various aspects of a second exemplary countdown ornament.
Figure 6B:
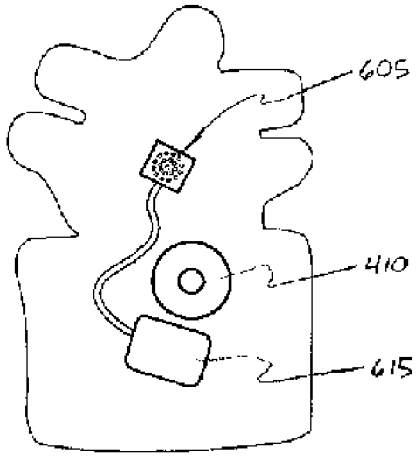
Figure 6C:
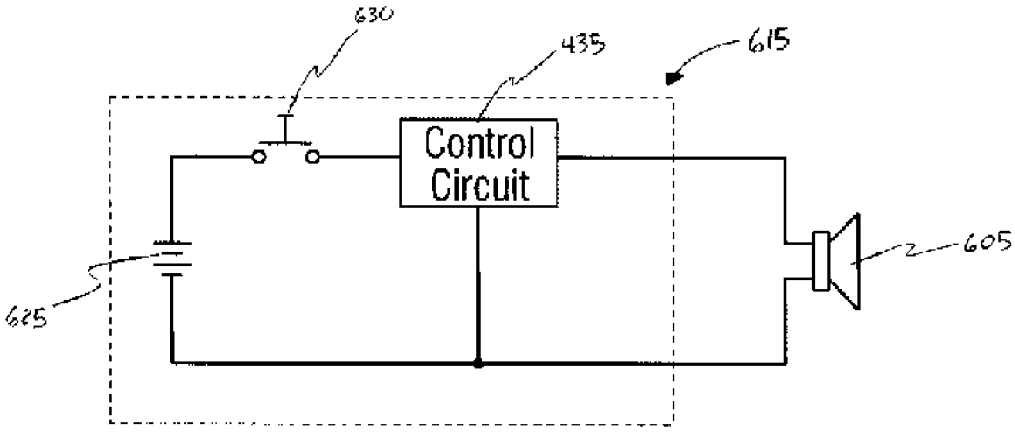
Figure 8:
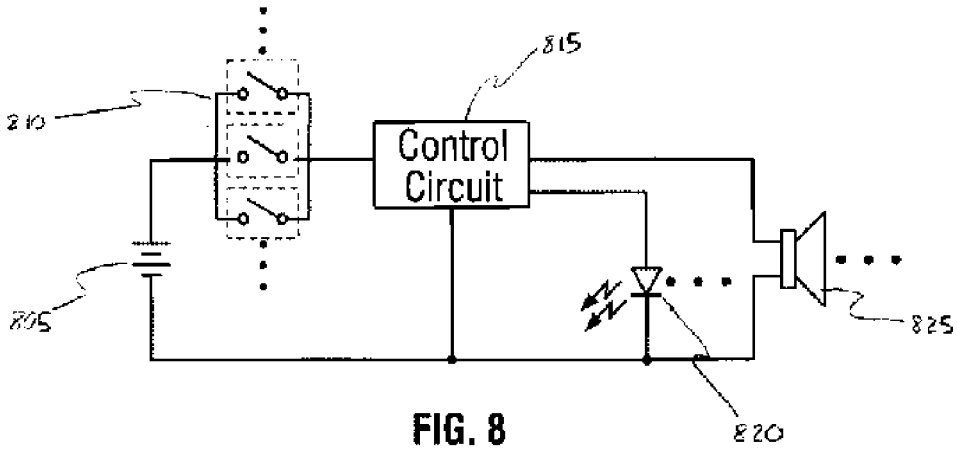
FIG. 8 is a schematic of a circuit for use in the fabric article of FIG. 1.

FIG. 5 shows an exemplary of a control circuit 500 suitable for use in the circuits of FIGS. 4C, 6C, and 8. The microcontroller 505 illustrated in this embodiment is a Winbond PowerSpeech™W588B Series voice synthesizer chip. The $C_{PS}$ capacitor 510 shunted between VDD, which is the microcontroller's 505 operating voltage pin, and ground may have a capacitance of 4.7 μF and is an optional component used to provide power stability to the microcontroller 505. The $C_{PN}$ capacitor 515 shunted between VDD and ground may have a much smaller capacitance of 0.1 μF and is required for this particular Winbond microcontroller 505 to filter out noise from the power supply. The $R_{LIMIT}$ resistor 520 may be used to limit the amount of current that is supplied to the microcontroller 505. The $R_{OSC}$ resistor 525 value may vary and depends on the frequency desired for the internal oscillator of the microcontroller 505. This particular Winbond microcontroller 505 includes memory for storing various speech or other tonal outputs of up to one hundred thirty-three seconds such that a "Ho, ho, ho!" sound effect or a longer holiday tune such as "Jingle Bells" or "Deck the Halls." Microcontroller 505 includes a built-in driver that provides a signal to the speakers through the pulse wave modulation (PWM) pins 530 on the chip. While this particular embodiment shows a microcontroller configured to activate a speaker, other timing or sequencing microcontrollers may be implemented to control the lights, vibratory elements, or other active devices included in the ornaments or fabric base unit.

FIG. 6 shows an audio ornament 600, which is another illustrative embodiment of a decorative ornament 120. Audio ornaments 600 have one or more audio devices 605 and a main body 406. Audio ornaments 600 may also include a secondary magnet 410 for attaching the ornament to the fabric article 100 by magnetic attraction to a primary magnet 210 disposed therein. The tune and duration of the sound output by a audio ornament 600 may be controlled by a sound-making ornament controller 615 located within the audio ornament 600. In some embodiments, this audio ornament controller 615 may also control and trigger other active elements such as LEDs or vibratory elements.

FIG. 6C shows a embodiment of an audio ornament controller 615. The ornament controller 615 may control the sound emitted from a speaker 620 or a different type of audio device. For example, in one embodiment, the ornament controller 615 may send signals to the speaker 620 to play a tune associated with the holiday. The ornament controller 615 may comprise a power source 625, a switch 630, and an ornament control circuit 435. The power source 625 may be a battery. Also, the switch 630 may be designed to respond to different types of stimuli. For example, the switch 630 may be a pressure-activated push button switch that activates the ornament control circuit 635 when pressed and deactivates the ornament control circuit 435 when released. In another embodiment, the switch 630 may be a toggle that provides power to the ornament control circuit 435 from the power supply 625 when toggled on and continues providing power to the ornament control circuit 435 until the switch 630 is toggled off.

Figure 7A:
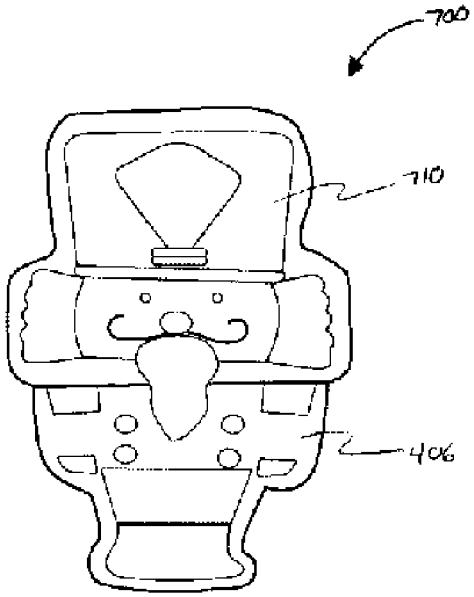
FIGS. 7A–7C illustrate various aspects of a third exemplary countdown ornament.
Figure 7B:
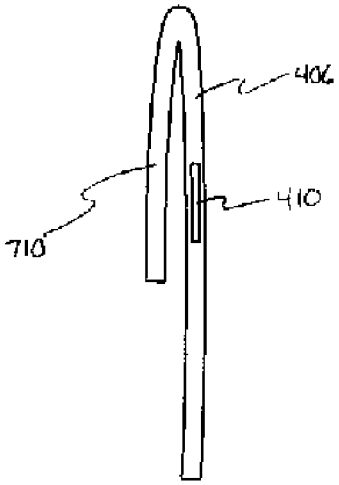
Figure 7C:
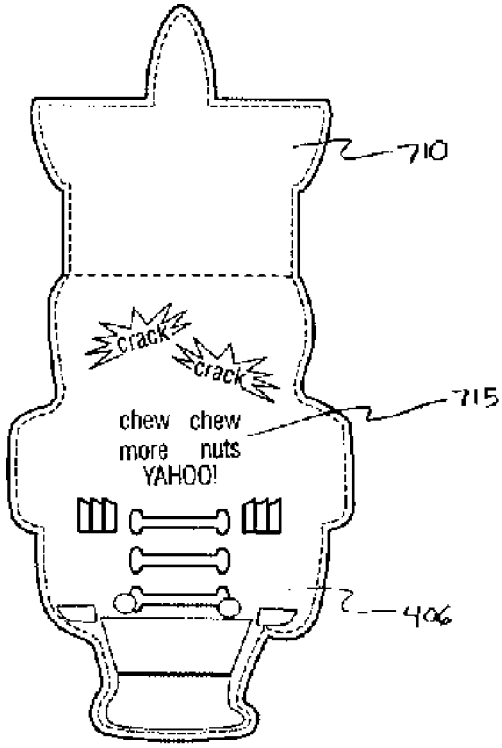

FIGS. 7A–7C show a mechanically-operable decorative ornament 700, which is another illustrative embodiment of a decorative ornament 120. The main body 406 of the mechanically-operable decorative ornament 700 is similar to the main body 406 of other types of decorative ornaments 120. However, in addition to the main body 406, some embodiments of mechanically-operable decorative ornaments 700 may include a flap 710 that allows a user to "open" the ornament to reveal a hidden item 715 inside. For example, a mechanically-operable decorative ornament 700 associated with Christmas may resemble a gift box that opens to reveal a hidden item 715 inside. Different types of hidden items 715 may include printed messages, holiday trinkets, or candy. As with the other types of decorative ornaments 120, mechanically-operable decorative ornaments 700 may contain a secondary magnet 410 for attaching the ornament to the fabric article 100 via coupling with one of the primary magnets 210 disposed within the fabric article 100. In yet another embodiment, the mechanically-operable decorative ornament 700 may be constructed as a finger puppet or other shape that may be manually operated by the user.

Each of the different types of decorative ornaments 120 described in association with FIGS. 4, 6, and 7 may be labeled with outwardly exposed ornament labels 205 as previously described in association with FIG. 2. Also, each different type of decorative ornament 120 may be designed to be child-safe such that even young children may participate in decorating the fabric article 100. In addition to the main body 406 of each different type of decorative ornament 120, the ornaments may include a holiday message 408. An illustrative example of a holiday message 408 displayed on a decorative ornament 120 is shown in FIG. 4A. In this particular embodiment, the holiday message 408 displayed reads "Merry Christmas," but the holiday message 408 may be any other suitable message associated with the holiday.

FIG. 8 shows one embodiment of a controller 215 for operating the interactive section 110 of the fabric article 100. The controller 215 may comprise a power source 805, a switch 810, and a control circuit 815. When activated, the control circuit 815 may control one or more lights 820 or speakers 825 or any other type of electrically active elements 130 that are included as part of the fabric article 100. The power source 805 may be a battery, a DC power supply, an AC power supply, or any other type of source sufficient to power the controller 215. Similarly, the switch 810 may be one of any number of devices to activate the control circuit 815 in response to certain stimuli. For example, the switch 810 may be a Reed switch that is normally open but that activates the control circuit 815 when a magnet is brought into close proximity with the switch 810. As another example, the switch 810 may be a pressure-activated switch that is normally open but that activates the control circuit 815 when a user presses on a certain portion of the fabric article 100. In one embodiment, a plurality of switches 810 may be used, each switch being located proximately to the countdown labels 125, such that whenever a user places a decorative ornament 120 on the fabric article 100, the controller 215 is activated and the lights 820 are activated or a song is played through the speakers 825. In certain embodiments, the control circuit 815 may control the electrically active elements 130 using timing circuitry. In this embodiment, the lights 820 or speakers 825 would be activated for a certain period of time and then be deactivated. The control circuit 815 may also control the electrically active elements 130 using sequencing or pattern generating circuitry. In this particular embodiment, the lights 820 or speakers 825 would be activated and deactivated according to a predefined pattern or sequence defined by the control circuit 815.

FIG. 9 shows a rear view of a decorative ornament 120 and a front view of the fabric article 100. The decorative ornament 120 may have a mechanical attachment device 905 to attach the decorative ornament 120 to the fabric article 100 via non-magnetic means. The mechanical attachment device 905 may be a hook or a loop that mechanically couples to a mechanical fastener 910 attached to the fabric article 100. As shown in FIG. 9, these mechanical fasteners 910 may be pegs that are attached to the front of the fabric article 100, thus allowing the user to hang the decorative ornaments 120 on the fabric article 100. In another embodiment, the mechanical attachment device 905 and the mechanical fastener 910 may be implemented with hook-and-loop fastener strips that attach to the back side of the decorative ornaments 120 and to the front side of the fabric article 100.

As used herein, the term "fabric" means cloth, felt, woven material, or any other material resembling one of the foregoing in appearance or tactile properties.

A number of embodiments have been described. Nevertheless, it will be understood that various modifications may be made and that other embodiments are within the scope of the following claims.

The invention claimed is:

1. An apparatus comprising:

a fabric article generally in the shape of a symbol associated with a holiday, said article including at least one substantially planar panel comprising fabric material;

a plurality of first magnetically attractable devices coupled to the panel, said first magnetically attractable devices being laterally spaced apart from one another;

a plurality of outwardly exposed indicia coupled to the panel, each of the indicia being associated with a number of days remaining until the holiday, and the indicia further being generally aligned with the first magnetically attractable devices; and a plurality of decorative ornaments having appearances associated with the holiday, each ornament including a second magnetically attractable device to secure the ornament to the fabric article proximal to one of the first magnetically attractable devices, wherein at least one of the decorative ornaments or the fabric article includes a circuit element including at least one audio device, light emitting device, or vibratory device.

2. The apparatus of claim 1, wherein said circuit element further comprises a control circuit to selectively activate the audio device, light emitting device, or vibratory device.

3. A Christmas decoration device, comprising:

a fabric article generally in the shape of a Christmas tree associated with a Christmas holiday, said fabric article including at least a front panel and a rear panel disposed substantially adjacent to one another, said front and rear panels comprising a felt material;

a plurality of first magnetic devices disposed adjacent to the front panel, said first magnetic devices being laterally spaced apart from one another;

a plurality of countdown labels coupled to the front panel of the fabric article, each countdown label being outwardly exposed from the front panel and being associated with a number of days remaining until the Christmas holiday, and the countdown labels further being generally aligned with the first magnetic devices disposed adjacent to the front panel such that the plurality of first magnetic devices are disposed rearward of the countdown labels;

a plurality of decorative ornaments having appearances associated with the Christmas holiday;

a plurality of second magnetic devices corresponding to the plurality of decorative ornaments and being magnetically attractable to the plurality of the first magnetic devices disposed adjacent to the front panel, wherein when one of the second magnetic devices is coupled to a corresponding one of the decorative ornaments, the corresponding one of the decorative ornaments is securable to the front panel proximal to one of the first magnetic devices;

a storage compartment at least partially defined by the fabric article, said compartment being sized to store the plurality of decorative ornaments; and a hanger member coupled to the fabric article so as to hang the fabric article from a surface.

4. The device of claim 3, wherein the plurality of first magnetic devices are disposed between the front and rear panels.

5. The device of claim 3, wherein at least one of the plurality of first magnetic devices and the plurality of second magnetic devices is a rare earth magnet.

6. The device of claim 3, further comprising at least one decorative ornament having a non-magnetic coupling to attach the ornament to the fabric article.

7. The device of claim 3, wherein at least one of the decorative ornaments or the fabric article includes a circuit element including at least one audio device, light emitting device, or vibratory device.

* * * * *